United States Patent [19]

Toyoda et al.

[11] 4,376,618

[45] Mar. 15, 1983

[54] ELECTROMAGNETIC PLUNGER PUMP

[75] Inventors: Akira Toyoda; Shizuo Arima, both of Tokyo; Katsumi Nozawa; Kenji Igarashi, both of Yokohama, all of Japan

[73] Assignee: Taisan Industrial Co., Ltd., Tokyo, Japan

[21] Appl. No.: 257,235

[22] Filed: Apr. 24, 1981

[30] Foreign Application Priority Data

Dec. 6, 1980 [JP] Japan ..... 55-174395

[51] Int. Cl.[3] ..... F04B 17/04

[52] U.S. Cl. ..... 417/417; 417/441

[58] Field of Search ..... 417/416, 417, 444, 511, 417/441, 496, 520

[56] References Cited

U.S. PATENT DOCUMENTS 2,405,143 8/1946 Holthouse ..... 417/417
2,474,349 6/1949 Dickey et al. ..... 417/417
3,874,822 4/1975 Nakamura ..... 417/417 X
4,308,475 12/1981 Haeck ..... 417/417

*Primary Examiner*—Leonard E. Smith
*Attorney, Agent, or Firm*—Laff, Whitesel, Conte & Saret

[57] ABSTRACT

An electromagnetic plunger pump includes a plunger which is electromagnetically activated. Normally, the plunger is supported in a balanced condition by a pair of opposing springs. Further, the plunger is vertically pierced by a hole extending along an axial line in which the plunger reciprocates in the vertical direction, responsive to an application of an intermittent electromagnetic force. A valve body is loosely fitted into a rod inserted in the vertical hole, reaching a contact portion of a discharge plunger, which interlocks with the electromagnetic plunger. The discharge plunger is forced shut by a spring acting in the valve closing direction. The valve body engages a valve seat to close a discharge passage during a pump shut-down. The valve body is liberated from the valve seat to open the discharge passage during pump operation.

5 Claims, 10 Drawing Figures

ELECTROMAGNETIC PLUNGER PUMP

The present invention relates to electromagnetic plunger pumps and more particularly to pumps in which an electromagnetic pressure plunger is supported in a balanced position by and between a pair of opposing springs. A discharge plunger is in reciprocal contact therewith, to perform a pumping function when a solenoid coil is energized by an intermittent electric current. The inventive pump is in a class of pumps which is exemplified by the following U.S. Pat. Nos.: 3,380,387; 3,468,257; 3,874,822; 3,958,902; 4,150,924 and British Pat. No. 2,293,684.

Generally, typical electromagnetic plunger pumps which have been conventionally used are either one of two types. In one type of pump, a solenoid valve is additionally provided outside and on the discharge side of the pump. The second type of pump incorporates a solenoid valve within the pump, and further may include a single solenoid coil which is used for activating both the electromagnetic plunger and an electromagnetically movable element. The second type of pump may also have two coils for respectively activating the electromagnetically movable element and for reciprocally moving the electromagnetic plunger to perform a pumping function.

These conventional electromagnetic plunger pumps have an additional solenoid valve. Whether it is located outside the pump or incorporated therein, the valve is disadvantageous because a solenoid valve is very expensive. Therefore, the production cost of the total pump inevitably increases. Particularly, the electromagnetic plunger pump having a built-in solenoid valve is also disadvantageous in that the required number of parts increases, and the construction of the pump is more complicated. As a result there is an increase in maintenance labor for normal and accurate operation of the pump. Furthermore, the electromagnetically movable element tends to attract foreign matter, which may cause chatter.

An object of the present invention is to provide a safe, inexpensive and reliable electromagnetic plunger pump, which can prevent liquid from leaking from a discharge port, due to the pressure either inside the pump or applied from a head to the inlet side when the pump is not in operation. Another object is to avoid providing any additional solenoid valve mechanism. A further object is to perform a pressure cut-off function which is the same as the function that is provided when there is a solenoid valve mechanism.

Still another object of the present invention is to provide an inexpensive electromagnetic plunger pump which is simple in the construction as well as reliable and durable in operation, over a long period of time.

In keeping with an aspect of the invention, an electromagnetic plunger pump includes an electromagnetically activated plunger which is normally supported in a balanced condition by a pair of opposed springs. The plunger is vertically pierced by a hole extending along an axial line in which the plunger reciprocates in the vertical direction, responsive to an application of an intermittent electromagnetic force. A valve body is loosely fitted into a rod which, in turn, is inserted in the vertical hole. The valve body reaches a contact portion of a discharge plunger, which interlocks with the electromagnetic plunger. The discharge plunger is forced shut by a spring acting in the valve closing direction.

The valve body engages a valve seat in a discharge passage to close the discharge passage during a pump shut-down. The valve body is liberated from the valve seat to open the discharge passage during pump operation.

The invention will be best understood from the following description and a study of the attached drawings, in which.

In order to remove the disadvantages which are mentioned above, and which are inherent in the conventional electromagnetic plunger pump with a solenoid valve mechanism, an electromagnetic plunger pump may have a shut-off valve built into the plunger, as has been suggested and is well known in the art. An example of such a pump appears in FIG. 1, in which a resilient material 8'' is attached directly to the electromagnetic plunger 1''. The resilient material 8'' is brought, under pressure, into contact with a valve seat 6'' which is provided in an intake passage to the pump. The pressure is applied to material 8'' by means of a return force of a lower spring 4'', which is seated under the plunger 1''.

With such a construction of the prior art pump, when a half-wave rectified commercial electric current of 60 Hz is applied to the pump, the electromagnetic plunger is vibrated at a rate of 60-times per minute. The repeated shock caused by such vibratory impacts is too strong for the plunger to bear. Accordingly, after the electromagnetic plunger pump is used for only a short period of time, the valved liquid will leak through the contact surface between the resilient material 8'' and the valve seat 6'', thus decreasing the reliability as a shut-off valve.

Figure 2:
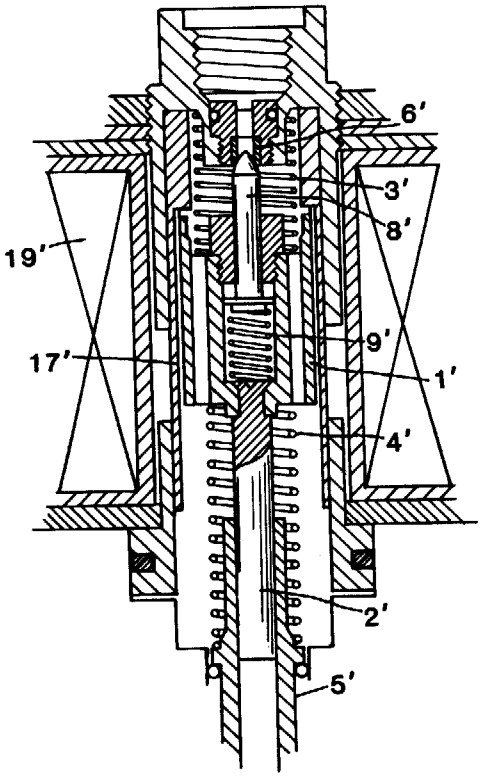
FIG. 2 (PRIOR ART)
FIG. 2 is a cross section of a second type of prior art valve.

Another and similar type of electromagnetic plunger pump is illustrated in FIG. 2. A needle valve 8' is secured to an electromagnetic plunger 1' which is supported by and between an upper spring 3' and a lower spring 4'. A pressure plunger 2' is connected to the electromagnetic plunger 1' and are both fitted into and supported by a guide case 17' and a cylinder 5', respectively. In order to maintain a required level of accuracy of the respective parts and the normal operating condition of the pump, a fixed clearance must be kept between the guide case 17' and the electromagnetic plunger 1', to reduce friction which is produced when plunger 1' slides along and within the guide case 17'.

It should be noted that when the electromagnetic plunger 1' slides vertically inside the guide case 17' responsive to an application of an electric current, the plunger 1' tends to be operated while being pulled toward one side of the guide case 17'. As a result, the needle valve 8' secured to the plunger 1' is also pulled toward the same side, and therefore needle 8' is out of alignment with the valve seat 6' in the discharge passage, which is coaxial with the plunger 1'. Thus, the needle valve 8' operates under eccentric conditions. Another spring 9' acts on the plunger 1' for pressing the needle valve 8' toward the valve seat 6' when the electric current is turned off. However, the reciprocal movement of the needle valve 8', in an eccentric position, with respect to the valve seat 6', leads to partial wear or even a breakage of the needle valve and to liquid leakage. If the needle valve 8' seizes in the valve seat 6', the pump fails to discharge the liquid.

Figure 3:
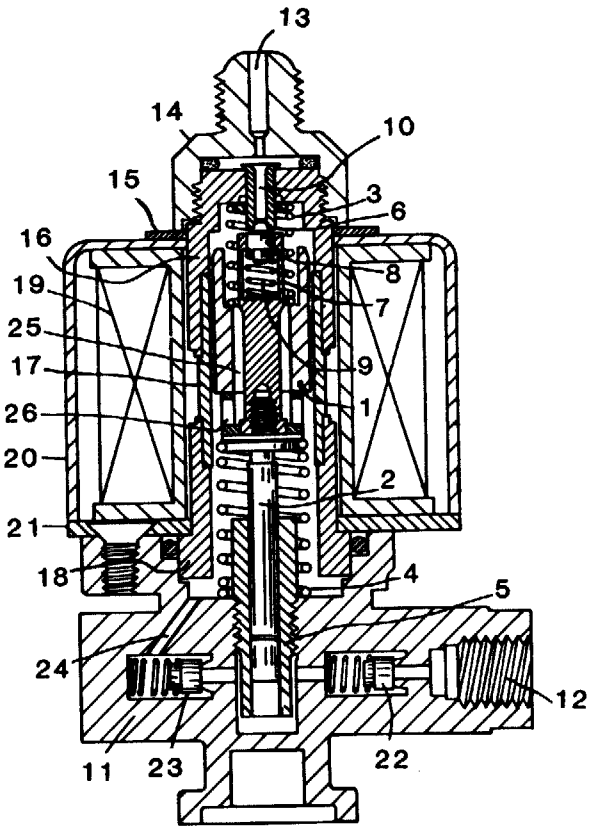
FIGS. 3 and 4 are cross sections of a first embodiment of the inventive pump, in closed and open positions, respectively.
Figure 4:
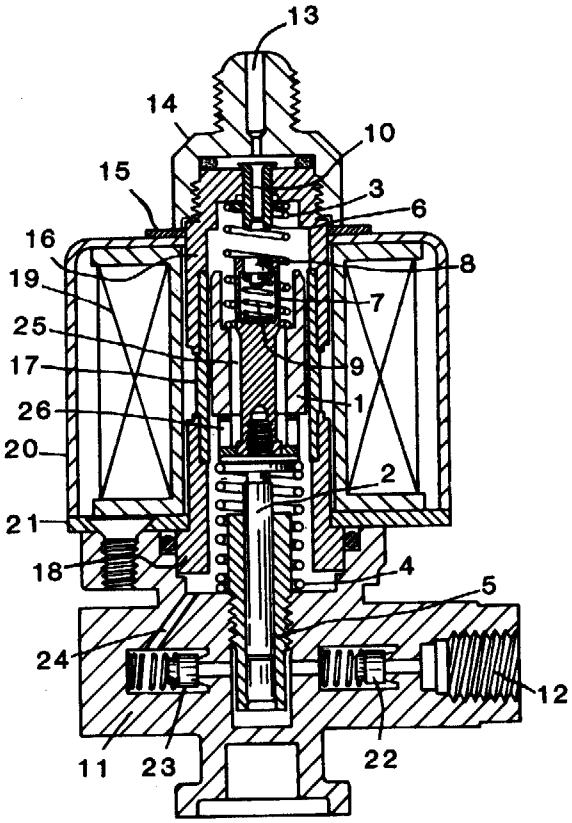

The following is a description of the present invention, by way of example with reference to FIGS. 3 and 4. The central, axial hole of a solenoid coil 19 is surrounded by a lower plate 21, an outer case 20 and magnetic metal seat 15. An annular magnetic pole piece 18, a plunger case 17 and an annular magnetic path piece 16 are all connected in sequence. The top end of the annular magnetic path piece 16 is capped by a threaded nut 14, which is attached through a magnetic metal seat 15 for fixing in place the outer case 20, lower plate 21, and an electromagnetic coil 19.

The inside of a passage extending from an intake port 12 is provided in a pump body 11 and completed through the central axial hole of the coil 19 to a discharge port 13 formed in the nut 14. This passage is kept air-tight with respect to the exterior of the valve assembly.

An electromagnetic plunger 1 is housed in the plunger case 17 in a manner which enables the plunger 1 to slidingly reciprocate within the case 17. A discharge plunger 2 is housed in a cylinder 5 within the pump body. The two plungers 1 and 2 are axially alligned. The electromagnetic plunger 1 and discharge plunger 2 are kept stationary and in contact with each other by an auxiliary spring 3 and a return spring 4 which are loaded between the top end portion of the inside hole of the annular magnetic path part 16 and the pump body 11. In the annular magnetic path part 16, there is a valve seat which projects into the discharge port 10.

A vertical through hole includes a liquid flow passage and is formed with and along the axis of the electromagnetic plunger 1. The lower end of plunger 1 reaches the contact portion of the electromagnetic plunger 1 and the discharge plunger 2. A rod is inserted into the vertical through hole. A cylinder 7 is formed at one end of plunger 1. A valve body 8 is provided in and engaged with the cylinder 7, and is movable to open and close the port of the cylinder 7. Valve body 8 is normally forced upwardly by a spring 9, to close the valve.

When the pump is not in operation, the tip of the valve body 8 is pressed against the valve seat 6 so that the discharge port 10, which is part of the liquid flow passage, remains closed. In this condition, the electromagnetic plunger 1 is held stationary by a balance of opposed spring forces appearing between the return spring 4 and the auxiliary spring 3. The magnetic center of the plunger 1 is positioned away from the center of the solenoid coil and toward the discharge part (i.e. is located in an upward position).

Next, the operation of the electromagnetic plunger pump will be described with reference to FIG. 4. An intermittent pulse current is supplied to the electromagnetic coil 19. When the electric current is supplied to the electromagnetic coil 19, a magnetic attraction forces the magnetic center of the plunger 1 toward the center of the coil 19. The resulting magnetic attraction forces the lower end of the plunger 1 toward the upper end of the annular magnetic pole piece 18, to minimize the magnetic resistance and to cause the electromagnetic plunger 1 to be displaced downwardly, to a great extent.

At this time, a restoration energy is built up in the return spring 4. When the current supply stops, the electromagnetic plunger 1 is moved upwardly by the restoration energy stored in the spring 4. Thus the plunger 1 makes a reciprocal motion in the vertical direction. This vertical and reciprocal motion of the electromagnetic plunger 1 causes a similar motion of the discharge plunger 2, which is connected to the plunger 1.

In combination with an opening and closing of the intake valve 22 and the discharge valve 23, such a vertical and reciprocal motion of the plunger 2 performs a pumping action, in such a manner that a liquid which is introduced through the intake port 12, flows within the plunger case 17 through a communication hole 24. The pumped liquid moves through the passages 26 and 25 respectively formed in the discharge plunger 2 and electromagnetic plunger 1, and further flows to the discharge hole 10, and finally is discharged from the discharge port 13.

Then before plunger 1 can return to its starting position, it is again pulled downwardly by magnetic attraction which occurs upon an application of the next current pulse. The repulsion force in the return spring 4 is supressed by the resistance of the liquid in the plunger case 17 to prevent a full expansion of the spring 4. Following this downward motion of the electromagnetic plunger 1, the discharge plunger 2 connected thereto is also moved downwardly. Thus, in the normal operation of the pump, the electromagnetic and discharge plungers 1 and 2 have a reciprocal motion within a range which keeps the valve seat 6 and the valve body 8 in an open position (that is, not in contact with each other).

Thus, the discharge passage is not completely closed. Therefore, there is no noise caused by collisions and there are no injuries in the relating parts. The possibility of a leakage of the liquid through the valve mechanism can be eliminated completely. Further, the service life of the pump can be prolonged remarkably.

The valve seat 6 may be integrally formed on the annular magnetic path part 16. Or, the seat 6 may be prepared separately and thereafter attached to the path part 16. The valve seat 6 is positioned with a high accuracy in alignment with the guide case 17. The tip of the valve seat 6 is rounded and preferably projects from the lower end of part 16 so that a seal can be enhanced between the valve body 8 and the valve seat 6, when they are engaged, to obtain a complete shut-off of liquid flow. The valve body 8 may be made of a resilient material and its contact surface is flat, with a sufficient area, as compared with the radial dimension of the valve seat 6. Even if the valve body 8 and the valve seat 6 are not aligned completely, there is no possibility of an injury to the valve seat, which injury has occurred in the conventional needle valve type arrangement. Thus, both the durability and the reliability of the shut-off valve can be increased.

Also, the valve body 8 can be formed spherically or semispherically in the surface which comes in contact with the valve seat 6. In this instance, it is not necessary to align the valve body 8 and the valve seat 6, provided that, if the vertical axes of the body 8 and seat 6 intersect, the angle of intersection is very small. In this condition, the valve body 8 can be substantially or completely seated on the valve seat 6, to fully close the liquid flow.

Figure 1:
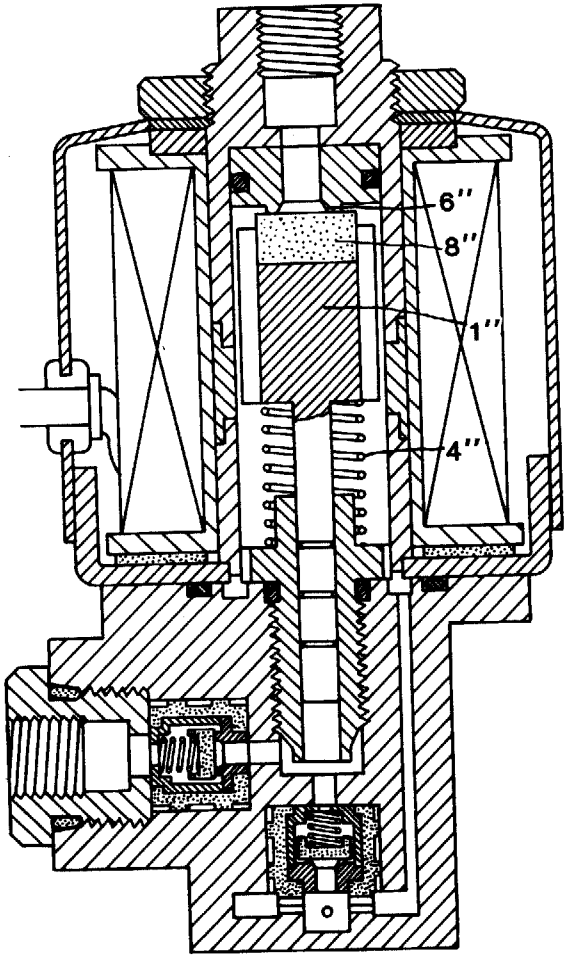
FIG. 1 (PRIOR ART)
FIG. 1 is a cross section of a first type of prior art valve.

In the conventional arrangements, as shown in FIGS. 1 and 2, there is an annular magnetic pole piece, in either arrangement. At the maximum outer diameter of the electromagnetic plunger 1, its outer portion also serves as a magnetic path. That is, the outer peripheral portion of the plunger 1 is positioned nearest the annular magnetic pole, so that the magnetic flux density becomes highest there. The sectional area of this portion is made as large as possible in order to improve the magnetic efficiency. However, from the structural viewpoint, it is also necessary to form a plurality of liquid flow grooves on the outer peripheral portion of the electromagnetic plunger as indicated by reference numerals 25'' (FIG. 1) and 25' (FIG. 2). Such a provision of the plural grooves naturally decreases the sectional area, reducing the magnetic efficiency.

According to the present invention, the structure of the electromagnetic plunger is characterized by the following advantages.

(1) A sufficient area of the cross section of the outer portion of the electromagnetic plunger can be maintained where the magnetic flux is concentrated, thus improving the magnetic efficiency in comparison with the conventional arrangements.

(2) The liquid flow passage is generally positioned in the central of the arrangement and, therefore, the turbulence and resistance of the liquid caused by the reciprocative motion of the plungers can be minimized.

(3) The electromagnetic plunger 1 and the discharge plunger 2 are formed separately and are connected to each other to provide a large contact area, thereby increasing the stability of the contact. Accordingly, even if these plungers 1 and 2 are not in precise geometrical alignment with the guide case 17, the free motion of the plungers is ensured and the frictional resistance between the plungers and the guide case can be minimized.

(4) A single through hole pierces the central portion of the assembly to simplify the fabrication and the manufacturing process of the pump. The high dimensional precision of the through hole is not required, thus causing a reduction in the number of the manufacturing steps and in the production cost.

As described heretofore, the present invention has increased the pumping efficiency, durability and reliability of the electromagnetic plunger pump.

Figure 5:
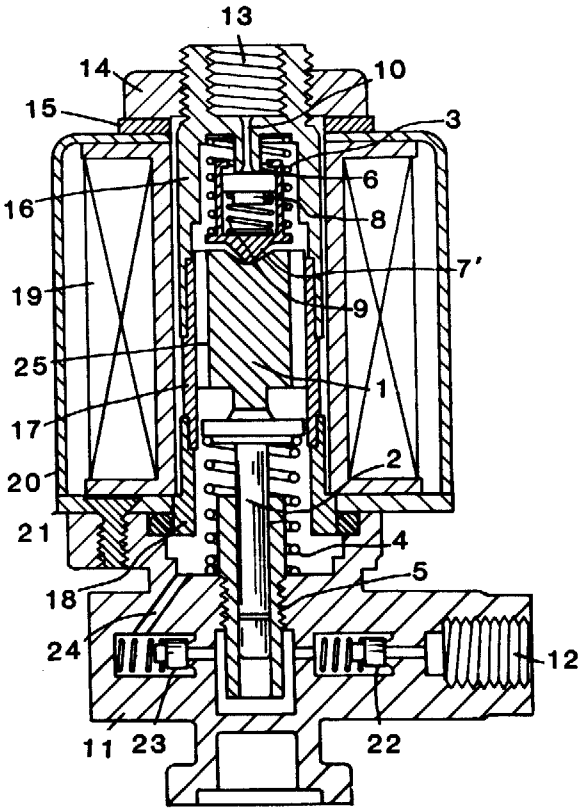
FIGS. 5 and 6 are similar cross sections of a second embodiment of the pump.
Figure 6:
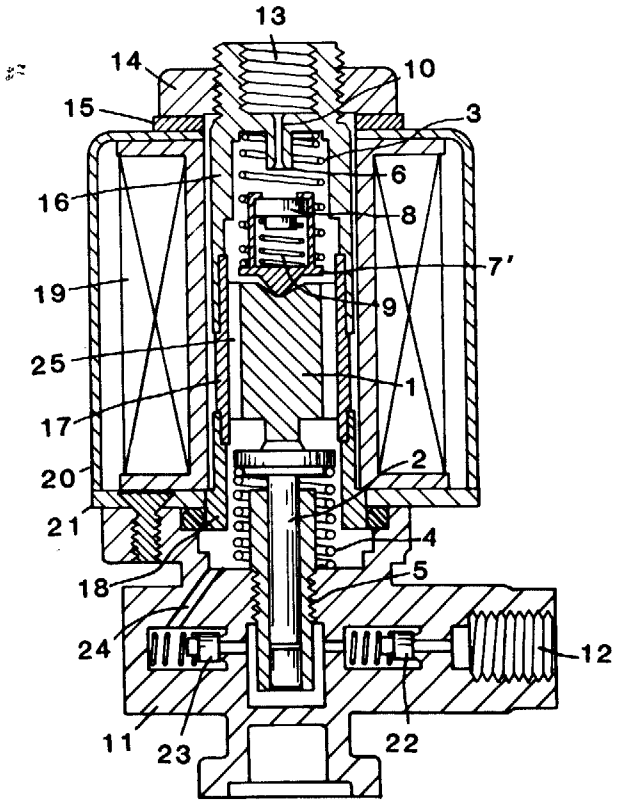

Next, another embodiment of the present invention will be made with reference to FIGS. 5 and 6.

In this particular embodiment, a spring receiving seat 7' is positioned between the electromagnetic plunger 1 and an auxiliary spring 3. The spring 9 rests on metal seat 7' and urges a valve body 8 to fully move in the vertical direction, that is in the valve closing direction. The electromagnetic plunger 1 is held stationary by the return spring 4 and the opposing auxiliary spring 3, in order to hold the tip of the valve body 8 in tight contact with the valve seat 6 when the electromagnetic pump is not in operation. The valve body 8 thus closes the discharge port 10 which constitutes a liquid flow passage. The magnetic center of plunger 1 is positioned upwardly with respect to the magnetic center of the electromagnetic coil 19 and toward the discharge side of the pump.

The electromagnetic plunger pump arrangement of the second embodiment is substantially identical with the pump of the first embodiment, except for the provision of the spring receiving metal seat 7'. Therefore, similar parts are identified by the same reference numerals throughout the drawings and a second detailed description thereof is omitted here for avoiding repetition.

The spring receiving metal seat 7' is brought into contact with the electromagnetic plunger 1 by the auxiliary spring 3. The contact portions of the seat 7' and the plunger 1 are formed in a conical shape respectively, but they have a slightly different angles of inclination. Thus, it is easy to compensate effectively for the displacement of the plunger 1 which is caused by the misalignment of the plunger 1 with the valve seat 6 within the guide case 17. This compensation has been achieved by a combination of the pressing force of the auxiliary spring 3 and the valve seat 6 coming into parallel contact with the valve body 8. The torsional moment produced by the expansion and compression of the auxiliary spring 3, during the reciprocal motion of the plunger 1, is prevented from acting on the plunger 1. Further, the plunger is rotatable so that the friction between the plunger 1 and the guide case 17 can be minimized. As a result, partial wear can be eliminated, thereby remarkably increasing the durability of the plunger 1.

Figure 7:
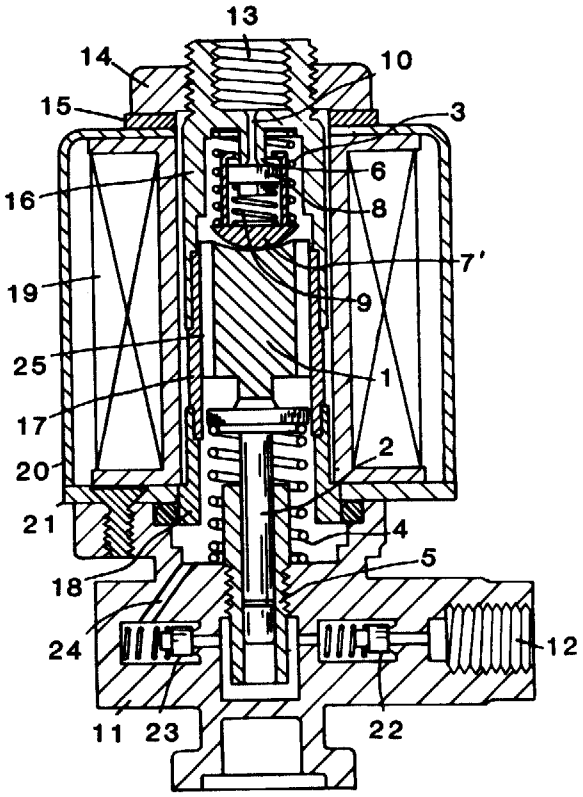
FIGS. 7 and 8 are similar cross sections of a third embodiment of the pump.
Figure 8:
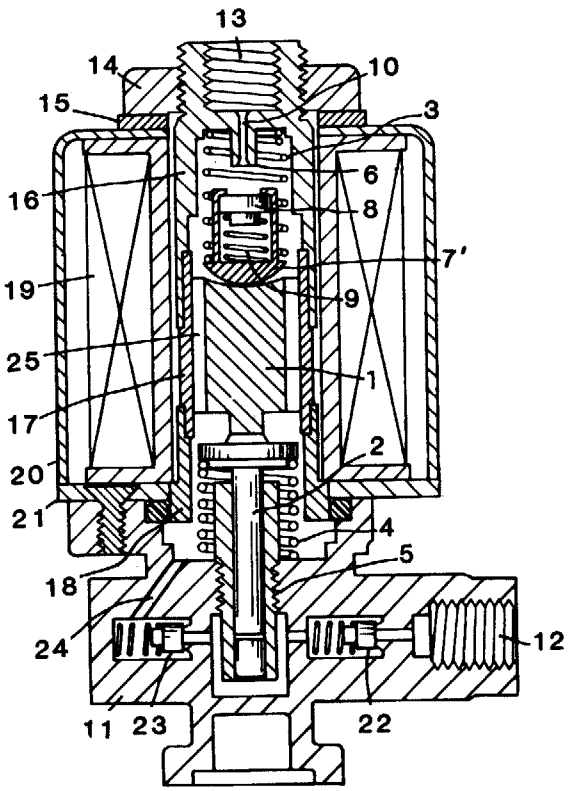

FIGS. 7 and 8 show a further embodiment of the present invention, in which the contact portions of the spring receiving metal seat 7' and the electromagnetic plunger 1 are formed in a spherical shape, respectively, but they have a slightly different radius. The operation of this embodiment is substantially the same as the operation in the embodiment shown in FIGS. 5 and 6.

Figure 9:
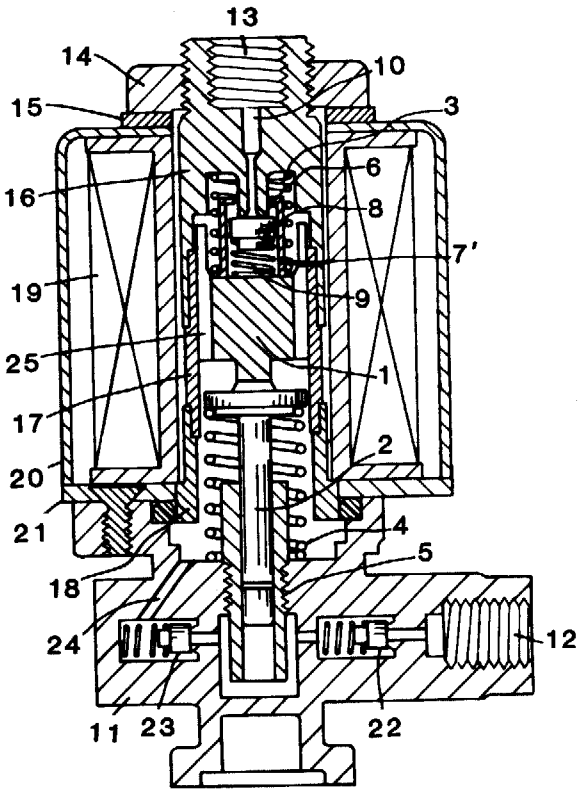
FIGS. 9 and 10 are similar cross sections of a fourth embodiment of the pump.
Figure 10:
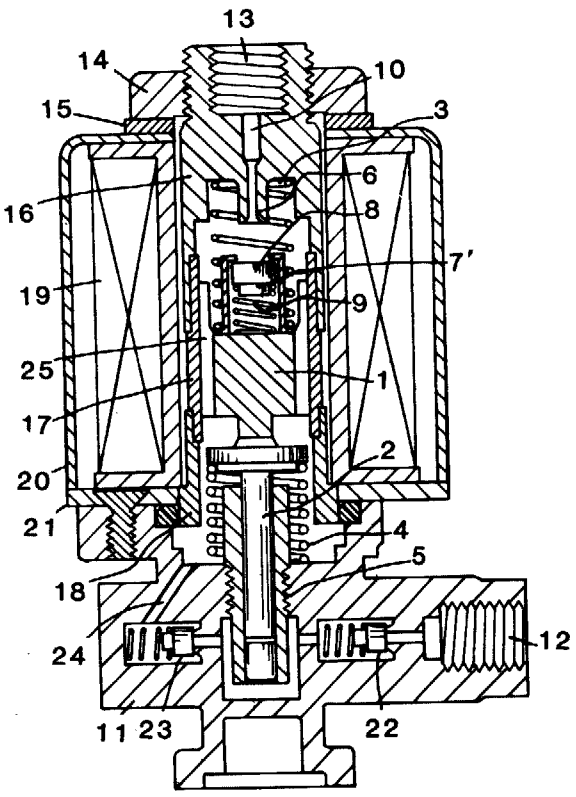

A still further embodiment of the present invention will next be described with reference to FIGS. 9 and 10. In this embodiment, a cylinder 7'' is provided on the auxiliary spring 3 side of the electromagnetic plunger 1, within which a valve body 8 is movably arranged to slide in the vertical direction. The spring 9 forces valve body 8 upwardly, that is, in the valve closing direction. When the electromagnetic pump is not in operation, the electromagnetic plunger 1 is held stationary by the balance between the opposed return spring 4 and the auxiliary spring 3, in order to hold the tip of the valve body 8 in tight contact with the valve seat 6 and to close the discharge port 10 which constitutes a liquid flow passage. The magnetic center of plunger 1 is positioned away from the magnetic center of the electromagnetic coil 19 and upwardly toward the discharge port.

The parts identified by the same reference numerals operate in the same manner as described in above connection with the embodiments shown in FIGS. 3 through 8, and therefore the detailed description thereof is omitted here.

It should be noted here that a modification of the present invention enables the electromagnetic plunger 1 to simultaneously function as the discharge plunger 2 in the pump arrangements shown in FIGS. 5 and 6, FIGS. 7 and 8, and FIGS. 9 and 10.

Those who are skilled in the art will readily perceive how to modify the system. Therefore, the appended claims are to be construed to cover all equivalent structures which fall within the true scope and spirit of the invention.

We claim:

1. An electromagnetic plunger pump including an elongated electromagnetic plunger means pressure-supported in a balanced position by an opposed pair of springs, a vertical through hole piercing said plunger means along its axial line, means for mounting said plunger for reciprocal motion in a vertical direction, means responsive to an application of an intermittent electromagnetic force for moving said plunger means against the urging of said pair of springs and along said axial line, valve body means loosely fitted into a vertical rod in said through hole and reaching a contact portion of a discharge plunger which interlocks with said electromagnetic plunger, and spring means for forcing said valve body in the valve closing direction, said valve body engaging a valve seat in a discharge passage to close said discharge passage during pump shut-down and to open said valve seat and said discharge passage during pump operation.

2. An electromagnetic plunger pump including an electromagnetic plunger means which is pressure-supported in a balanced position by an opposed pair of springs, means responsive to an application of an intermittent electromagnetic force for causing said plunger means to make a reciprocal motion in the vertical direction, valve body means loosely fitting into a spring receiving metal seat interposed between said electromagnetic plunger and another spring resting on said metal seat, and means responsive to said other spring for urging said valve body means in a valve closing direction, said valve body engaging a valve seat to close a discharge passage during pump shut-down and to open said valve seat and said discharge passage during pump operation.

3. An electromagnetic plunger pump including an electromagnetic plunger means which is pressure-supported in a balance positioned by an opposed pair of springs, means responsive to an application of an intermittent electromagnetic force for causing said plunger means to make a reciprocal motion in the vertical direction, valve body means loosely fitting into one end portion of said electromagnetic plunger, said body engaging a a valve seat to close a discharge passage during pump shut-down and to open said valve seat and said discharge passage during pump operation.

4. The electromagnetic plunger pump of any one of the claims 1 to 3, wherein said valve body and said valve seat have mating surface in the form of a flat plane.

5. The electromagnetic plunger pump of anyone of the claims 1 to 3, wherein said valve body and said valve seat have mating surfaces which have a spherical form.

* * * * *